US011642700B2

(12) United States Patent
Thies et al.

(10) Patent No.: US 11,642,700 B2
(45) Date of Patent: May 9, 2023

(54) SCREEN APPARATUS

(71) Applicant: Glatt Maschinen- und Apparatebau AG, Pratteln (CH)

(72) Inventors: Jochen Thies, Loerrach (DE); Adrian Kape, Rheinfelden (DE); Heinz Pritzke, Braunsdorf (DE)

(73) Assignee: Glatt Maschinen- und Apparatebau AG, Pratteln (CH)

( * ) Notice: Subject to any disclaimer, the term of this patent is extended or adjusted under 35 U.S.C. 154(b) by 214 days.

(21) Appl. No.: 16/768,123

(22) PCT Filed: Nov. 7, 2018

(86) PCT No.: PCT/EP2018/080436
§ 371 (c)(1),
(2) Date: May 29, 2020

(87) PCT Pub. No.: WO2019/105700
PCT Pub. Date: Jun. 6, 2019

(65) Prior Publication Data

US 2020/0316647 A1 Oct. 8, 2020

(30) Foreign Application Priority Data

Dec. 1, 2017 (DE) ..... 10 2017 221 731.6

(51) Int. Cl.
*B07B 1/06* (2006.01)
*B07B 1/20* (2006.01)
(Continued)

(52) U.S. Cl.
CPC ..... *B07B 1/06* (2013.01); *B02C 23/30* (2013.01); *B07B 1/20* (2013.01); *B07B 4/08* (2013.01); *B07B 11/06* (2013.01)

(58) Field of Classification Search
CPC .. B07B 1/06; B07B 1/20; B07B 1/469; B07B 4/08; B07B 11/06; B07B 7/06; B02C 23/30
(Continued)

(56) References Cited

U.S. PATENT DOCUMENTS 4,466,542 A * 8/1984 Oetiker ..... B03B 4/02 209/318
5,653,346 A * 8/1997 Frei ..... B07B 1/42 209/254
(Continued)

FOREIGN PATENT DOCUMENTS

CN 1550260 A 12/2004
CN 101272862 A 9/2008
(Continued)

*Primary Examiner* — Gene O Crawford
*Assistant Examiner* — Muhammad Awais
(74) *Attorney, Agent, or Firm* — The Webb Law Firm

(57) ABSTRACT

A screen apparatus for screening granulate, in particular moist and/or dry granulate, having a screen housing having a base, a cover and a side wall, an inlet for the granulate arranged on the screen housing, an outlet for the screened granulate arranged on the screen housing, a screen arranged in the screen housing and an inlet for transfer air. The outlet for the screened granulate, which is arranged on the screen housing is arranged on the side wall of the screen housing.

15 Claims, 5 Drawing Sheets

(51) Int. Cl.
*B07B 4/08* (2006.01)
*B02C 23/30* (2006.01)
*B07B 11/06* (2006.01)

(58) Field of Classification Search
USPC ..... 241/49
See application file for complete search history.

(56) References Cited

U.S. PATENT DOCUMENTS

| | | | | |
|---|---|---|---|---|
| 6,216,875 | B1 * | 4/2001 | Stone | B07B 1/06 209/152 |
| 7,967,226 | B2 | 6/2011 | Göeke | |
| 8,973,759 | B2 * | 3/2015 | Ichikawa | B07B 1/06 399/253 |
| 9,022,220 | B2 * | 5/2015 | Ozeki | B07B 1/42 209/233 |
| 2003/0168537 | A1 | 9/2003 | Hart et al. | |
| 2004/0056128 | A1 | 3/2004 | Uebayashi et al. | |
| 2004/0251348 | A1 | 12/2004 | Irwin | |
| 2017/0087596 | A1 * | 3/2017 | Vasanthan | B07B 13/16 |

FOREIGN PATENT DOCUMENTS

| | | | | | |
|---|---|---|---|---|---|
| CN | 106670107 | A | * | 5/2017 | |
| CN | 106670107 | A | | 5/2017 | |
| CN | 106969613 | A | * | 7/2017 | B07B 1/04 |
| CN | 206661386 | U | | 11/2017 | |
| DE | 3138430 | A1 | * | 9/1981 | |
| DE | 102008038645 | A1 | * | 2/2010 | B07B 1/06 |
| DE | 102014112154 | A1 | | 3/2016 | |
| EP | 0159050 | A1 | | 10/1985 | |
| EP | 3031527 | A1 | * | 6/2016 | B02C 13/284 |
| FR | 462736 | A | * | 2/1914 | |
| FR | 462736 | A | | 2/1914 | |
| GB | 2002259 | A | | 2/1979 | |
| JP | 10113929 | A | | 5/1998 | |
| JP | 2005518940 | A | | 6/2005 | |
| JP | 2005270893 | A | | 10/2005 | |
| JP | 2007216116 | A | | 8/2007 | |
| WO | WO-9108059 | A1 | * | 11/1990 | |
| WO | 9108059 | A1 | | 6/1991 | |
| WO | 2004048006 | A1 | | 6/2004 | |
| WO | WO-2004048006 | A1 | * | 6/2004 | B07B 1/18 |

* cited by examiner

SCREEN APPARATUS

CROSS-REFERENCE TO RELATED APPLICATIONS

This application is the United States national phase of International Application No. PCT/EP2018/080436 filed Nov. 7, 2018, and claims priority to German Patent Application No. 10 2017 221 731.6 filed Dec. 1, 2017, the disclosures of which are hereby incorporated by reference in their entirety.

BACKGROUND

Field of the Invention

The invention relates to a screen apparatus for screening granulate, in particular moist and/or dry granulate, comprising a screen housing having a base, a cover and a side wall, an inlet for the granulate arranged on the screen housing, an outlet for the sieved granulate arranged on the screen housing, a screen arranged in the screen housing and an inlet for transfer air.

Related Art

Screen apparatuses for granulates, in particular for a wet granulation process or a drying process in a screening process downstream of a fluidisation apparatus have long been the state of the art. The known screen apparatuses are filled via an inlet for the granulate arranged on the cover of the screen apparatus and emptied following the screening process via an outlet arranged after a suction shoe in the base of the screen apparatus. Here, transport of the granulate from the inlet to the outlet takes place, by way of example, via a gravity feed or pneumatic delivery.

The disadvantage of such screen apparatuses for granulates known from the state of the art, in which the, for example, moist granulate has to be transferred to a dryer is that these screen apparatuses have or require a large construction height and thus the space must also be available to create a process engineering system equipped with a known screen apparatus. Furthermore, the known screen apparatuses have the disadvantage that due to the at least to some extent conical form of the suction shoe of the screen housing of the known screen apparatus, as a result of buildup and adhesions of granulate in the conically shaped region (suction shoe) of the screen housing the product transfer of screened granulate is significantly restricted.

SUMMARY

The object of the invention is to provide a screen apparatus which minimises buildup or adhesions of granulate and at the same time requires a lower construction height of the screen housing and therefore eliminates the disadvantages from the state of the art.

This object is achieved with a screen apparatus of the abovementioned type, in that the outlet for the screened granulate (product) arranged on the screen housing is arranged in the side wall of the screen housing. In this way the required construction height of the screen apparatus is advantageously reduced, whereby installation in existing, for example process engineering, systems is simplified. The construction height is, by way of example, considerably reduced through the elimination of the conical region, also known as a suction shoe, below the screen, that is necessary according to the state of the art. In this way, buildup or adhesion of granulate in the screen housing, but in particular in the region of the screened granulate outlet, is prevented whereby throughout the operation a sufficiently fast and sufficiently good product transfer of the screened granulate is ensured. Through the compact design according to the invention, firstly there is a saving on the necessary construction height of the screen apparatus due to the elimination of the suction shoe and at the same time the inner surface of the screen housing in contact with the product is also reduced.

Particularly preferably, the screen apparatus according to the invention is used for screening moist and/or dry granulate, particularly preferably for a wet granulation process or a drying process in a fluidisation apparatus, by way of example a screening process downstream of a fluidised bed or similar.

In an advantageous configuration the screen housing has a cylindrical design, wherein the side wall of the screen housing has an at least partially conical form. As a result of such a geometrical configuration of the screen apparatus further space, including installation space, is saved whereby integration of the screen apparatus according to the invention into existing systems can be further improved.

In particular, it has been shown that particularly preferably the outlet for the screened granulate (product) arranged on the screen housing is arranged tangentially to the side wall of the screen housing. Through the arrangement of the outlet for the granulate tangentially to the side wall of the screen housing an optimised discharge of the screened granulate is achieved. In addition, through the tangential arrangement buildup or adhesions in the region of the outlet are minimised and a faster and trouble-free transport of the screened granulate is ensured.

In a preferred embodiment, the outlet for the screened granulate is arranged above the inlet for transfer air. Through the tangential flow/movement of the transfer air in the screen housing the centrifugal forces act on the granulate and drive or carry it upwards. Thus, it is advantageous to arrange the outlet for the screened granulate (product) above the inlet for the transfer air.

In addition, the screen apparatus is preferably designed so that the configuration of the screen arranged in the screen housing corresponds to the design of the screen housing. Thus, the inner surface in contact with the product is reduced, i.e. the available areas for buildup or adhesions in the screen housing are minimised, so that a faster and trouble-free transport of the screened granulate is ensured.

In a preferred configuration of the screen apparatus according to the invention, the screen apparatus has a grinding body arranged in particular in the screen housing. The advantage of a grinding body arranged in the screen housing is that in this way pressing of the granulate through the screen can be improved. By means of the grinding body the screening process is therefore optimised.

In an embodiment of the screen apparatus preferred in this regard, the grinding body arranged in the screen housing is arranged above the screen. The grinding body arranged in the screen housing is rotatably arranged; particularly preferably the grinding body can be driven by a motor, in particular an electric motor. Thus, the screening process is further optimised.

The configuration of the grinding body arranged in the screen housing is particularly preferably corresponds to the design of the screen. This matching of the grinding body to the shape of the screen considerably improves the performance of the screening process, since the granulate to be screened is pushed by means of the grinding body matched to the shape of the screen through the screen under a continuous and even pressure.

In a further preferred embodiment of the screen apparatus according to the invention, the screen apparatus has an inlet for transfer air, wherein the inlet for transfer air is preferably arranged on the side wall of the screen housing, particularly preferably tangentially to the side wall of the screen housing. Transfer air denotes gaseous media, preferably air, but also inert gases. Through the supply of transfer air, product transport is improved. In addition, in the screen housing of the screen apparatus an air flow is created, which minimises or totally prevents buildup or adhesions of granulate on the inner surface of the screen housing. In particular, the preferably lateral, but particularly preferable tangential, arrangement of the inlet for transfer air creates very good flow conditions for the transfer air in the screen housing for preventing buildup or adhesions of granulate and in connection with the granulate transport through the outlet.

According to a further preferred embodiment of the screen apparatus according to the invention, the screen apparatus has a rotor disc, which is in particular arranged between the screen arranged in the screen housing and the base of the screen housing and particularly preferably has at least a partially conical configuration. The advantage of a roto disc arranged between screen and base in the screen housing is that this serves to protect the seal below the screen and to prevent the product remaining on the base, i.e. on the lower horizontal level of the screen housing.

Particularly preferably, the rotor disc is arranged on a shaft driven by a motor, whereby an improved transfer of the screened granulate is ensured.

BRIEF DESCRIPTION OF THE DRAWINGS

The invention is explained in more detail below with reference to the attached drawing. Which shows as follows:

DETAILED DESCRIPTION

Figure 1:
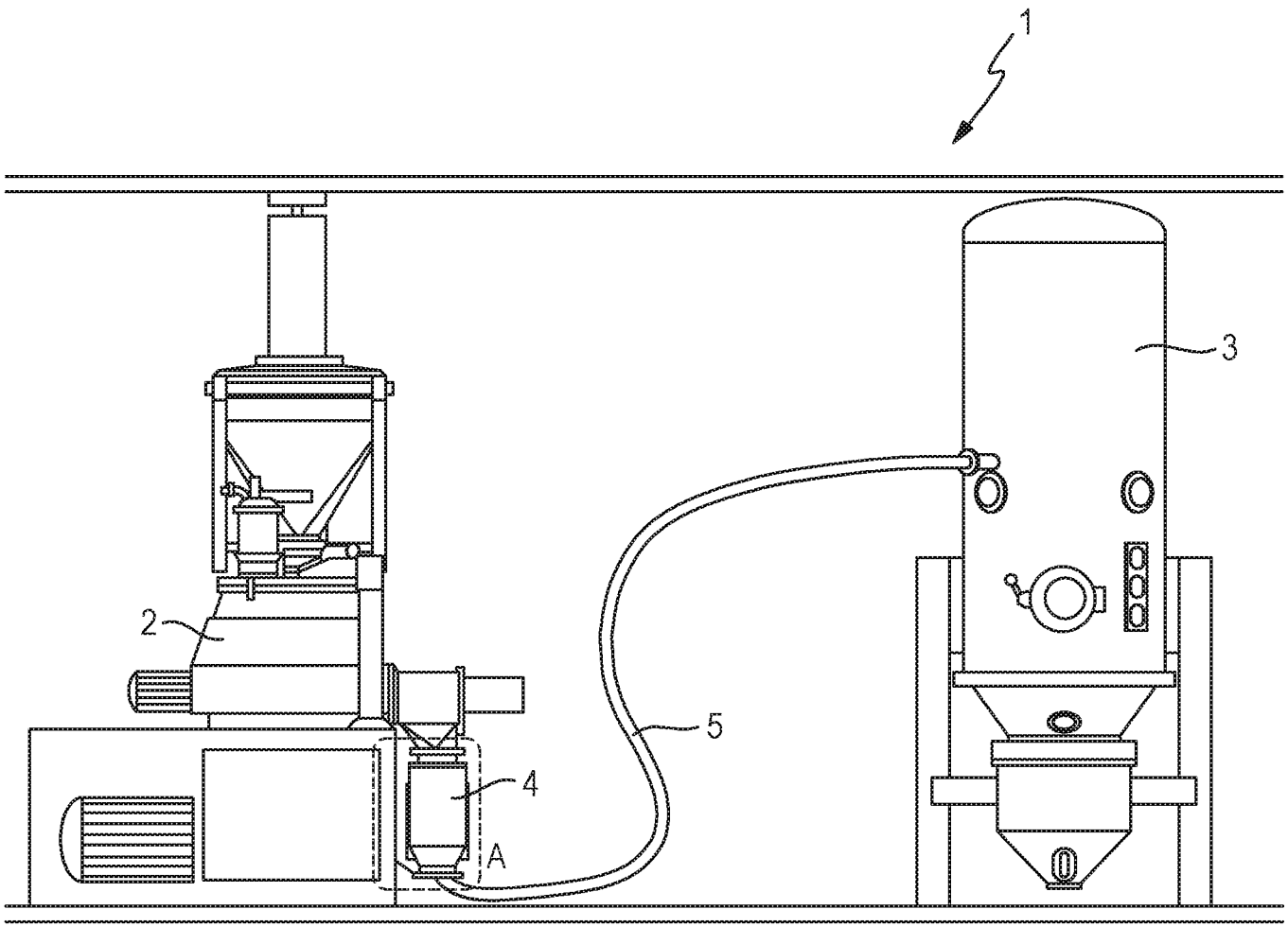
Figure 2:
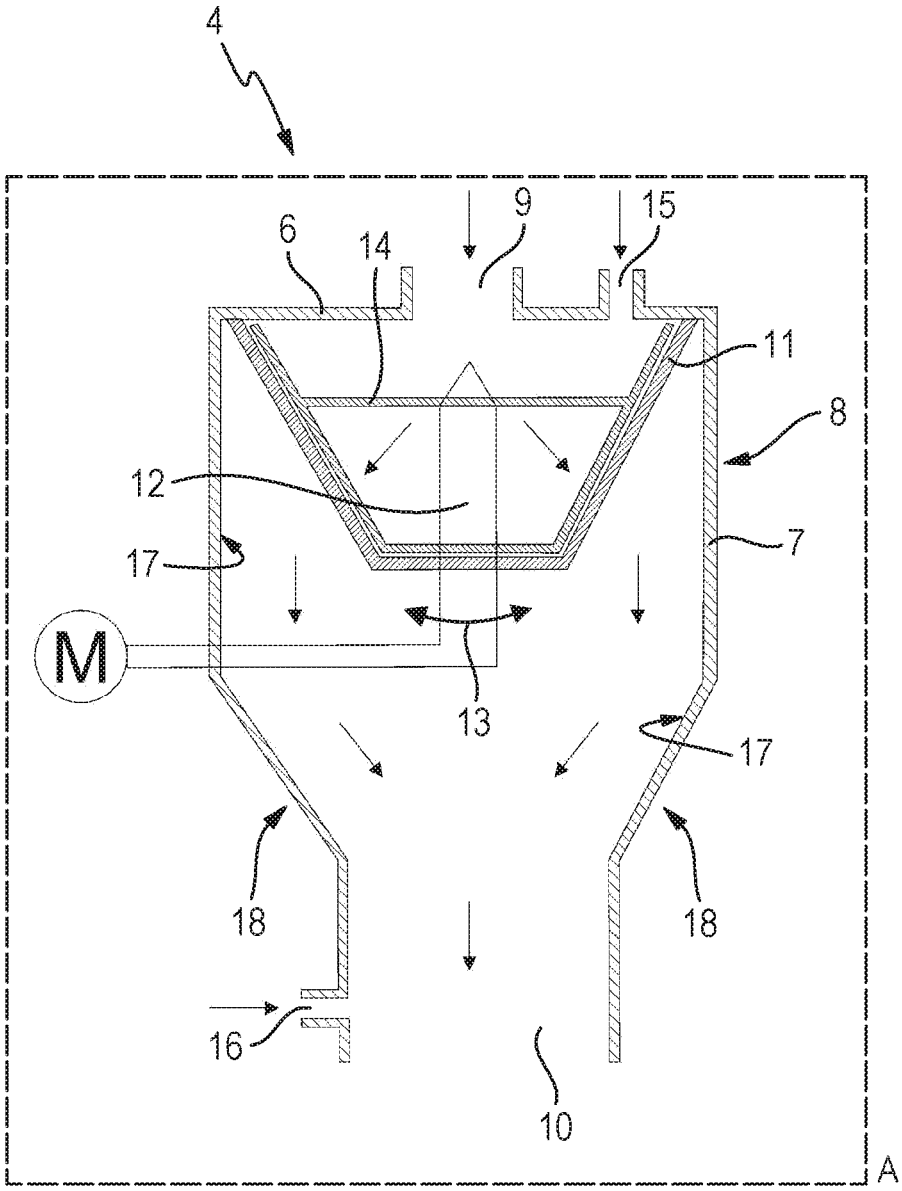
Figure 3:
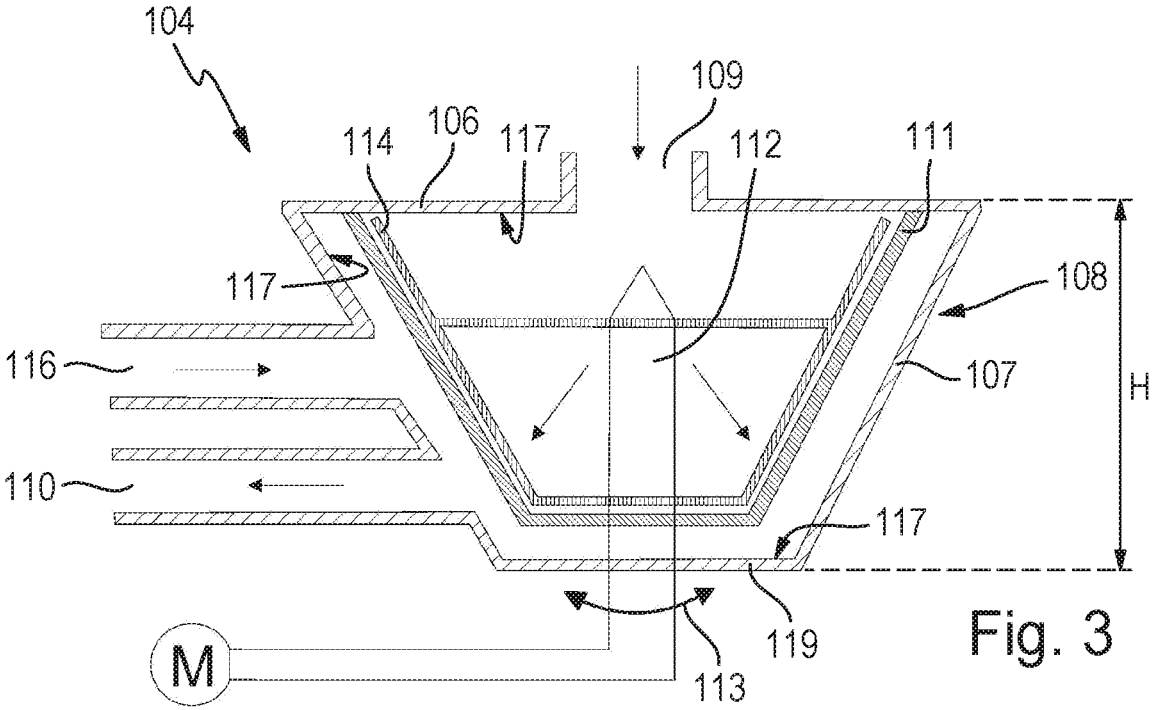
Figure 4:
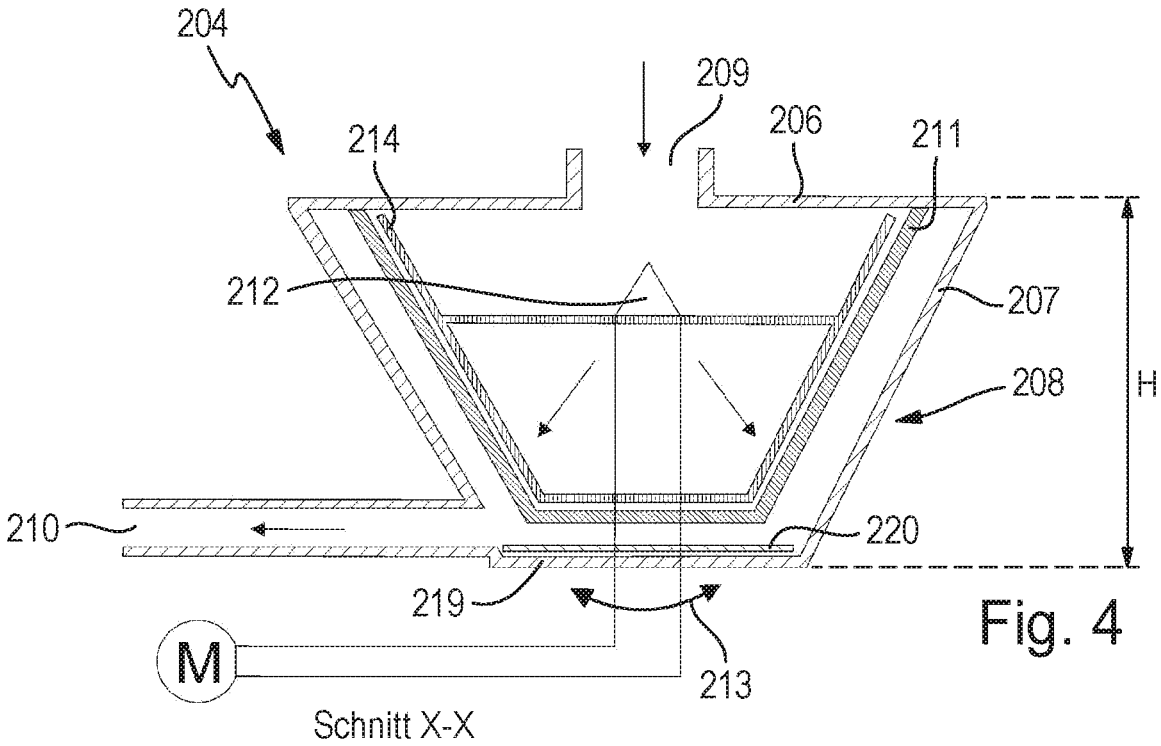
Figure 5:
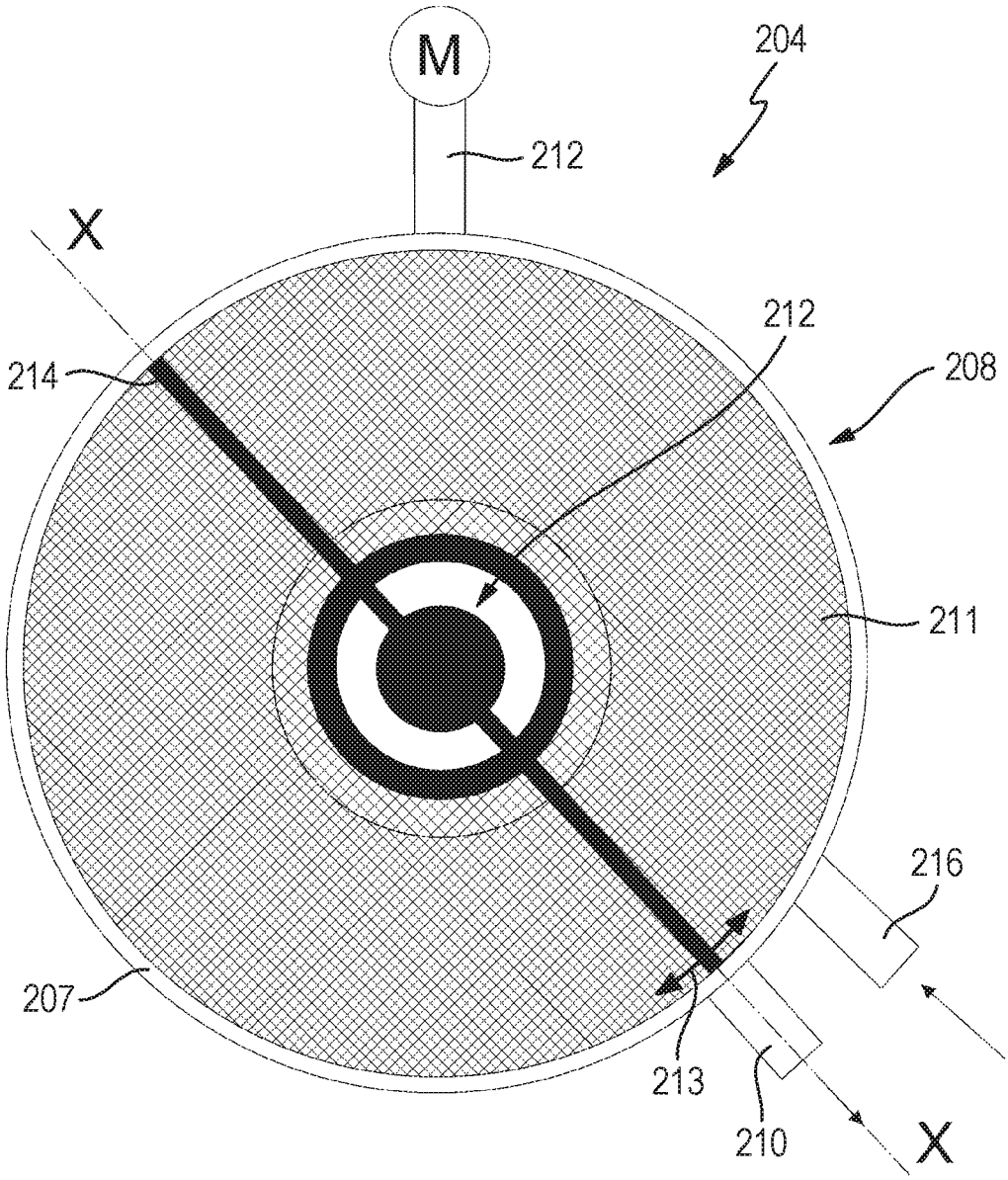
Figure 6:
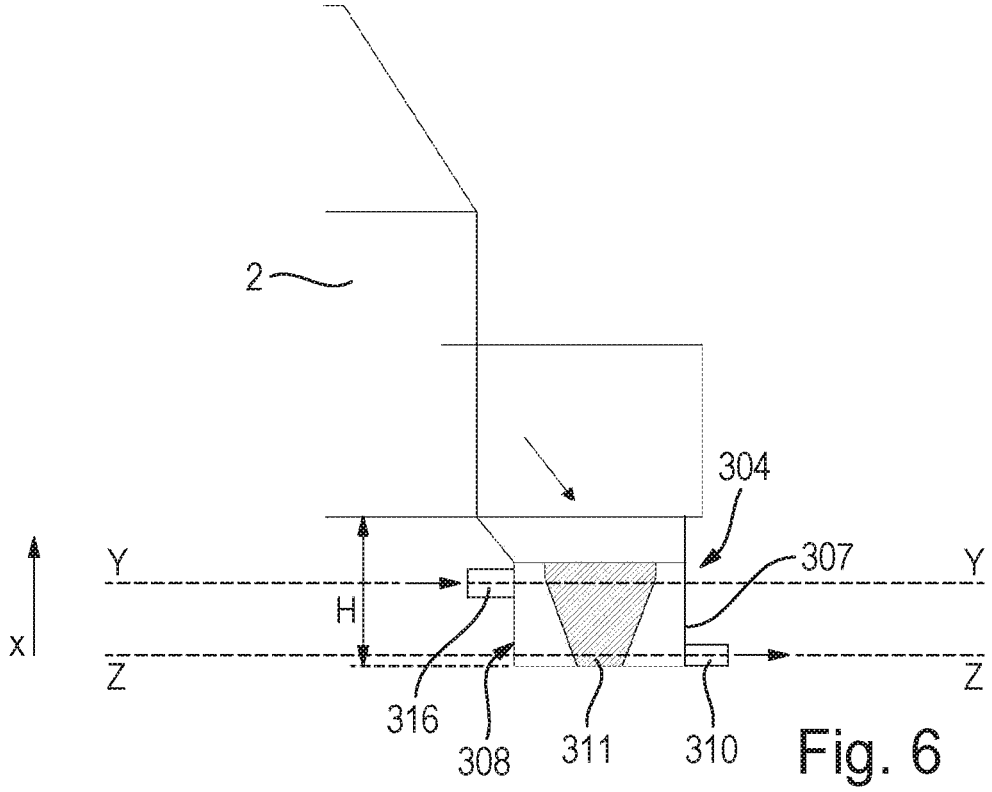
Figure 7:
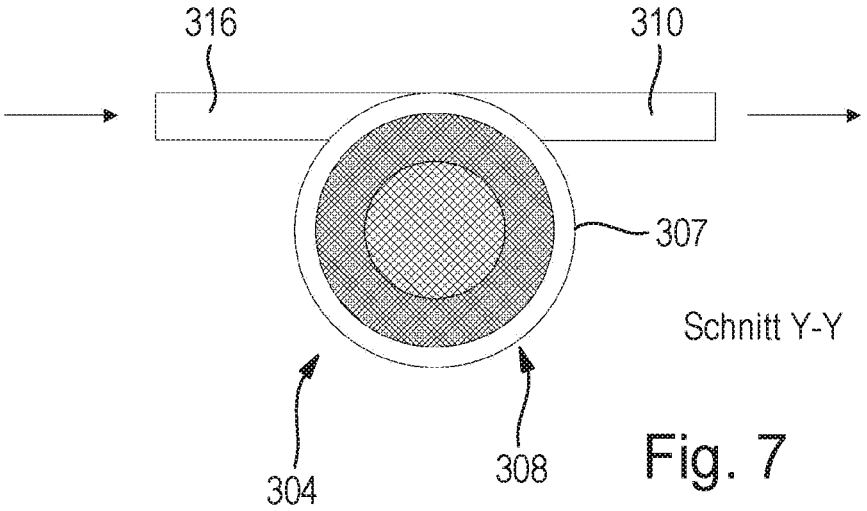

FIG. 1 a simple schematic representation of a basic design of a granulation line from the state of the art with a screen apparatus on the outlet of a high-shear granulator;

FIG. 2 a cross section of a detailed view of a screen apparatus from the state of the art according to detail A of FIG. 1;

FIG. 3 a cross section of a first exemplary embodiment of a screen apparatus according to the invention with an outlet for the granulate arranged laterally on the screen housing and an inlet for the transfer air arranged laterally on the screen housing;

FIG. 4 a cross section of a second exemplary embodiment of a screen apparatus according to the invention with a rotor disc arranged in the screen housing and an outlet for the granulate arranged laterally on the screen housing according to sectional plane X-X in FIG. 5;

FIG. 5 a top view of the second exemplary embodiment of the screen apparatus according to the invention with an outlet for the granulate arranged laterally on the screen housing and an inlet for the transfer air arranged laterally on the screen housing;

FIG. 6 a cross section of a schematic representation of a high-shear granulator with screen apparatus according to the invention arranged thereon; and FIG. 7 a top view of the schematic representation shown in FIG. 5 of a screen apparatus according to the invention arranged on a high-shear granulator.

DETAILED DESCRIPTION

FIG. 1 shows a simple schematic representation of a basic design of a granulation line 1 known from the state of the art. In order, by way of example, to pass the moist granulate from a high-shear granulator 2 to a dryer 3 a transfer of the granulate is required. This transfer is carried out either by gravity feed of the dryer 3 or by pneumatic delivery. In the case of gravity feed, the granulate drops, propelled by its own weight, into the dryer 3. However, this type of feeding requires a large installation height and the available space to create the granulation line 1. In the granulation line 1 shown in FIG. 1, between the high-shear granulator 2 and the dryer 3 a screen apparatus 4 is shown on the outlet of the high-shear granulator 2. The outlet of the screen apparatus 4 is connected to the dryer 3 by a flexible hose line 5.

FIG. 2 shows a cross section of a detailed view of a screen apparatus 4 known from the state of the art according to detail A from FIG. 1 for performing the granulate screening process, in particular for a screening process downstream of a wet granulation process or a drying process in a fluidised bed.

The screen apparatus 4 comprises a cover 6 and a screen housing 8 having a side wall 7. Furthermore, the screen housing 8 also has an inlet 9 for the granulate arranged in the cover 6 of the screen housing 8 and an outlet 10 arranged on the screen housing 8. In the screen housing 8 a screen 11 for screening the granulate is arranged such that all granulate entering via the inlet 9 is captured by the screen 11. In the screen housing 8 the screen 11 is also associated with a grinding body 14 rotatable on a shaft 12 driven by a motor M in the direction of arrow 13. In order to ensure the transfer of the granulate, by way of example, into a dryer 3 following screening, above and below the screen 11 of the screen apparatus 4 transfer air is fed in via inlets. The feeding in of transfer air to the screen apparatus 4 is carried out above the screen 11 via a first inlet 15 arranged in the cover 6 and via a second inlet 16 arranged after the screen 11.

The granulate, which is emptied via the inlet 9 arranged in the cover 6 into the screen apparatus 4, is pressed by the rotating grinding body 14 through the mesh of the screen 11. At the start of the emptying of the granulate of the, in the exemplary embodiment, upstream high-shear granulator 2, most of the granulate is emptied in one action into the screen 11 of the screen apparatus 4. Thus, before and after the screen 11 arranged in the screen housing 8 blocking of the inlet 9 and the outlet 10 of the screen apparatus 4 often occurs. Blocking occurs, by way of example, due to buildup or adhesions of granulate on the inner surface 17 of the screen housing 8 in contact with granulate, preferably in the conically shaped region 18 of the screen housing 8, since the conically configured region 18 considerably reduces the passage area of the screen housing 8 available for the granulate towards the outlet 10 of the screen housing 8. By way of example, in actual applications the diameter of the screen housing 4 of 400 mm is reduced to a diameter of the outlet 10 of 100 mm. Furthermore, in the configuration of the screen apparatus 4 known from the state of the art, rounded chunks of granulate, which cannot be transported through the screen 11 usually form and remain in the screen 11 as wastage.

FIG. 3 illustrates a cross section of a first exemplary embodiment of a screen apparatus 104 according to the invention with an outlet 110 for the granulate to be screened arranged laterally on the screen housing 108 and an inlet 116 for transfer air arranged laterally on the screen housing 108.

The screen apparatus 104 according to the invention for performing the granulate screening process, in particular for a screening process downstream of a wet granulation process or a drying process in a fluidised bed, according to the first exemplary embodiment comprises a screen housing 108 with a base 119, a cover 106 and a side wall 107. In addition, the screen apparatus 104 has an inlet 109 arranged on the screen housing 108, an outlet 110 arranged on the screen housing 108, a screen 111 arranged in the screen housing 108 and a grinding body 114 arranged in the screen housing 108, wherein the outlet 110 arranged on the screen housing 108 is arranged in the side wall 107 configured as a single piece of the screen housing 108, particularly preferably tangentially to the side wall 107 of the screen housing 108. While the product flow in the screen apparatus known in the the state of the art took place from top to bottom, in the new geometry according to the invention of the screen apparatus 104 the screened granulate is evacuated through the outlet 110 arranged on the side wall 107 of the screen housing 108.

In the exemplary embodiment according to FIG. 3, the screen housing 108 has a cylindrical design that is conical over its full installation height H, and tapers from the cover 106 to the base 118 of the screen housing 108. Other design configurations are conceivable. In the first embodiment, the side wall 107 is designed as a one-piece conically-shaped side wall 107. However, the side wall 107 can also be multipart, e.g. having at least two side wall sections. In addition, a plurality of inlets 109 and outlets 110 can also be arranged on the screen housing 108. The number, position and/or geometry of the inlets 109 may vary. With regard to the outlets 110, at least the number and/or geometry may vary. The position of the outlets 110 is at least restricted to the extent that at least one of the outlets 110 is arranged laterally on the screen housing 108.

The screen apparatus 104 shown in FIG. 3 also comprises a grinding body 114 mounted on a shaft 112, preferably rotatably driven by a motor M, particularly preferably an electric motor or similar, in the arrow direction 113. The shape of the grinding body 114 is matched to the screen 111, so that the granulate can be pressed under continuous and even pressure from the grinding body 114 through the mesh of the screen 111. For a further improved transfer of the granulate to be screened through the screen apparatus 104 comprising the screen 111, transfer air is fed to the screen apparatus 104 via the inlet 116. In the exemplary embodiment an inlet 116 is arranged on the side wall 107 of the screen housing 108. The inlet 116 can also be designed to have a variable number, position and/or geometry. The inlet for the transfer air 116 is preferably arranged below the outlet 110 for the screened granulate (product), and so the reverse of that shown in FIG. 3, laterally on the screen housing 108. Through the tangential movement of the air, the centrifugal forces act on the granulate and drive or carry it upwards in the direction of the outlet 110 preferably arranged above the inlet for the transfer air 116.

The geometries of the screen housing 108, screen 111 and/or grinding body 114 are preferably, as also stated in the first exemplary embodiment, matched to one another in order to further optimise the screening process. Through the matching of the various geometries to one another, apart from a reduction in the installation height, through dispensing with an additional suction shoe the internal free surface of the screen apparatus, in particular of the screen housing, is minimised.

In the first exemplary embodiment shown in FIG. 3 the granulate enters the screen apparatus 104 via inlet 109. Due to the matched geometries of the screen housing 108, screen 111 and grinding body 114 there is little buildup or few adhesions, since the inner surface 117 in contact with the granulate during the screening process is minimal. In addition, in the circumferential direction of the screen housing 108 fewer granulate adhesions or less buildup occur or these are transported away more quickly via the outlet 110, since through the transfer air flowing laterally via the inlet 116 in conjunction with the inner surfaces 117 with minimal contact, optimised flow conditions can be created in the screen housing 108. The screened granulate is evacuated through the outlet 110 arranged on the side wall 107 of the screen housing 108.

FIG. 4 shows a cross section of a second exemplary embodiment of a screen apparatus according to the invention 204 with a rotor disc 220 arranged in the screen housing 208 and an outlet 210 for the granulate arranged laterally on the screen housing 208 according to sectional plane X-X in FIG. 5.

Like the first exemplary embodiment, the second exemplary embodiment according to the invention comprises a screen housing 208 with a base 219, a cover 206 and a side wall 207. Furthermore, the screen apparatus 204 also has an inlet 209 for the granulate arranged on the screen housing 208, an outlet 210 for the screened granulate (product) arranged on the screen housing 208, a screen 211 arranged in the screen housing 208 and a grinding body 214 associated with the screen 211 in the screen housing 208, wherein the outlet 210 for the screened granulate arranged on the screen housing 208 is arranged in the side wall 207 of the screen housing 208, particularly preferably tangentially to the side wall 207 of the screen housing 208. The grinding body 214 associated with the screen 211 is rotatably arranged on a shaft 212 driven by a motor M, preferably an electric motor or similar, in the arrow direction 213. The grinding body 214 is arranged above the screen 211 in the screen housing 208, whereby the granulate to be screened is continuously pressed under constant pressure through the screen 211. The screen apparatus 204 of the second exemplary embodiment according to FIG. 4 has an inlet 216, not shown here, for transfer air.

The statements made regarding the first exemplary embodiment according to the invention in relation to the side walls, inlet, transport air inlet and outlet and so on, are equally applicable to the second exemplary embodiment according to the invention.

The screen apparatus 204 according to the invention in the second exemplary embodiment has a cylindrical design of the screen housing 208, wherein the design of screen housing 208 of the screen apparatus 204 is conical over its full installation height H of the screen housing 208, and tapers from the cover 206 to the base 219. The configuration of the screen 211 arranged in the screen housing 208 of the screen apparatus 204 corresponds to the design of the screen housing 208. In addition, the configuration of the grinding body 214 arranged in the screen housing 208 of the screen apparatus 204 corresponds to the design of the screen 211. Thus, screen housing 208, screen 211 and grinding body 214 are optimally matched to one another.

Unlike the screen apparatus 104 of the first exemplary embodiment the screen apparatus 204 also has a rotor disc 220. Here, the rotor disc 220 is arranged between the screen 211 and the base 219 of the screen housing 208 of the screen apparatus 204. The rotor disc 220 is arranged on a shaft 212 that can be driven by the motor M. Thus, rotor disc 220 and grinding body 2014 are mounted on a shaft 212 and are always driven at the same speed of rotation. It is also conceivable for the rotor disc 220 and the grinding body 214 of the screen 211 to be drivable independently of one another, by way of example in each case by a separate motor, in particular an electric motor or similar. Here, the rotor disc 220 and the grinding body 214 are arranged on different shafts. Preferably, the rotor disc 220 of the screen apparatus 204 has an at least partially conical design. The arrangement of the rotor disc 220 serves to protect the seal below the screen 211 and to prevent product remaining on the base 219 and not being transported further in the direction of the suction of the outlet 210. Thus, an even better and more complete transfer of the product is achieved and buildup or adhesions of the granulate in the region of the base 211 of the screen housing 208 and the side wall 207 of the screen housing 208 minimised.

A further improvement in the product transfer is achieved in that the inlet 216, not shown here, for transfer air is arranged on the side wall 207 of the screen housing 208; preferably the inlet 216 not shown here, for transfer air is attached tangentially to the side wall 207 of the screen housing 208.

FIG. 5 illustrates a top view of the second exemplary embodiment of the screen apparatus 204 according to the invention with an outlet 210 for the granulate arranged laterally on the screen housing 208 and an inlet 216 for transfer air. The grinding body 214 driven by a motor M and arranged on a shaft 212 is arranged above the screen 211 in the screen housing 208, which has a cover 206, not shown here, and a base 219, not shown here, as well as a side wall 207, and is located in the sectional plane X-X. The inlet 216 for the transfer air is arranged on the side wall 207 of the screen housing 208, laterally offset from the sectional plane X-X.

By the rotation of the grinding body 214 in the arrow direction 213 the granulate is pressed or pushed through the screen 211. The screening process is optimised by the transfer air that enters the inlet 216. The combination of rotating grinding body 214 and transfer air results in an improved granulate screening process.

FIG. 6 shows a cross section of a schematic representation of a part of a high-shear granulator 2 with a third exemplary embodiment of a screen apparatus 304 according to the invention arranged on a high-shear granulator 2. The inlet 316 for the transfer air is arranged tangentially to the cylindrical screen housing 308 of the screen apparatus 304. The outlet 310 is similarly tangentially arranged on the cylindrical screen housing 308 of the screen apparatus 304. In the exemplary embodiment, the inlet 316 is located in the horizontal sectional plane Y-Y through the screen apparatus 304; in the third exemplary embodiment the outlet 310 is located in the similarly horizontal sectional plane Z-Z through the screen apparatus 304. In the third exemplary embodiment the horizontal sectional planes Y-Y and Z-Z are offset to one another above the installation height H of the screen housing 308 of the screen apparatus 304. However, such an offset between sectional planes Y-Y and Z-Z is not absolutely essential. In the third exemplary embodiment, the transfer air is fed to the screen housing 308 of the screen apparatus 304 through the inlet 316 and compared to the discharge of the screened granulate through the outlet 310 of the screen housing 308 of the screen apparatus 304 is located in a higher position of the screen housing 308 of the screen apparatus 304 in the x-direction.

The statements made regarding the first exemplary embodiment according to the invention in relation to the side walls, inlet, transport air inlet and outlet and so on, are equally applicable to the third exemplary embodiment according to the invention.

The granulate coming from the high-shear granulator 2 enters the screen apparatus 304 and is pushed by a grinding body 314, not shown here, through the screen 311 with continuous pressure evenly distributed across the screen 311. Through the inlet 316 arranged in the upper region of the screen housing 308 tangentially to the side wall 307 of the screen housing 308 transfer air also enters the screen housing 304 of the screen apparatus 308 and a helical, downward airflow opposite to the x-direction is generated within the cylindrical screen housing 308 of the screen apparatus 304. This airflow carries with it granulate that has built up or adhered on the way through the screen housing 308 to the screen housing 308 in the direction of the outlet 310 and thereby prevents a blockage of the screen apparatus 304 by the granulate itself. By means of the outlet 310 arranged tangentially to the side wall 307 of the screen housing 308 optimum suction of the granulate and the transfer air is ensured.

FIG. 7 shows a top view of the schematic representation shown in FIG. 6 of a screen apparatus 304 according to the invention arranged on a high-shear granulator 2 according to the third exemplary embodiment. It is clear here that the inlet 316 for transfer air and the outlet 310 for the product are arranged on the same side of the screen housing 308. Furthermore, both the inlet 316 and the outlet 310 run tangentially to the side wall 307 of the screen housing 308 of the screen apparatus 304.

For each geometry of the screen apparatuses 104, 204 and 304 according to the invention that is used, it is sufficient to draw in the transfer air, preferably via an outlet 110, 210, or 310 arranged tangentially to the side wall 107, 207 or 307 and thereby achieve a faster and more reliable product transfer.

The invention claimed is:

1. A screen apparatus for screening granulate, comprising
(a) a screen housing having a base, a cover and a side wall,
(b) an inlet for the granulate arranged on the screen housing,
(c) an outlet for the screened granulate arranged on the screen housing,
(d) a screen having at least a partially conical form arranged in the screen housing, and
(e) an inlet for transfer air, wherein the outlet for the screened granulate arranged on the screen housing is arranged on the side wall of the screen housing and the screen apparatus has a grinding body configured to correspond to the design of the screen, and arranged in the screen housing.

2. The screen apparatus according to claim 1, wherein the screen housing has a cylindrical design.

3. The screen apparatus according to claim 1, wherein the screen housing has an at least partially conical form.

4. The screen apparatus according to claim 1, wherein the outlet for the screened granulate arranged on the screen housing is arranged tangentially to the side wall of the screen housing.

5. The screen apparatus according to claim 1, wherein the outlet is arranged above the inlet for transfer air.

6. The screen apparatus according to claim 1, wherein the configuration of the screen arranged in the screen housing corresponds to the design of the screen housing.

7. The screen apparatus according to claim 1, wherein the grinding body arranged in the screen housing is arranged above the screen.

8. The screen apparatus according to claim 1, wherein the grinding body arranged in the screen housing is rotatable.

9. The screen apparatus according to claim 1, wherein the grinding body arranged in the screen housing can be driven by a motor.

10. The screen apparatus according to claim 1, wherein the inlet for transfer air is arranged on the side wall of the screen housing.

11. The screen apparatus according to claim 10, wherein the inlet for transfer air is arranged tangentially to the side wall of the screen housing.

12. The screen apparatus according to claim 1, wherein the screen apparatus has a rotor disc.

13. The screen apparatus according to claim 12, wherein the rotor disc is arranged in the screen housing between the screen and the base of the screen housing.

14. The screen apparatus according to claim 13, wherein the rotor disc can be driven by a motor.

15. The screen apparatus according to claim 13, wherein the rotor disc has an at least partially conical design.

* * * * *